United States Patent [19]

Muncrief

[11] Patent Number: 5,057,168

[45] Date of Patent: Oct. 15, 1991

[54] METHOD OF MAKING LOW DENSITY INSULATION COMPOSITION

[76] Inventor: Paul M. Muncrief, 4771 Quail Run, Las Cruces, N. Mex. 88001

[21] Appl. No.: 397,980

[22] Filed: Aug. 23, 1989

[51] Int. Cl.[5] ..... B32B 5/26

[52] U.S. Cl. ..... 156/62.6; 156/279; 428/296; 428/298; 428/302

[58] Field of Search ..... 156/62.6, 62.8, 279, 156/296; 428/296, 284; 19/163, 145.5; 264/112, 113, 122, 126

[56] References Cited

U.S. PATENT DOCUMENTS

| | | | |
|---|---|---|---|
| 2,483,406 | 10/1949 | Francis, Jr. | 156/628 X |
| 2,635,322 | 4/1953 | McDermott | 156/276 |
| 3,740,282 | 6/1973 | Watson | 156/148 |
| 3,756,893 | 9/1973 | Smith | 156/441 |
| 4,039,711 | 8/1977 | Newman | 428/296 X |
| 4,051,294 | 9/1977 | Buck, Jr. et al. | 156/62.6 X |

*Primary Examiner*—Michael W. Ball
*Assistant Examiner*—Nancy T. Krawczyk
*Attorney, Agent, or Firm*—Tod R. Nissle

[57] ABSTRACT

A method and apparatus for producing a low density thermal insulation batt. The batt includes binder fibers which have been softened to adhere to and interconnect insulative fibers in the batt, and also includes short stilt fibers which interconnect and space apart the insulative fibers to define interstitial air pockets intermediate the insulative fibers.

12 Claims, 1 Drawing Sheet

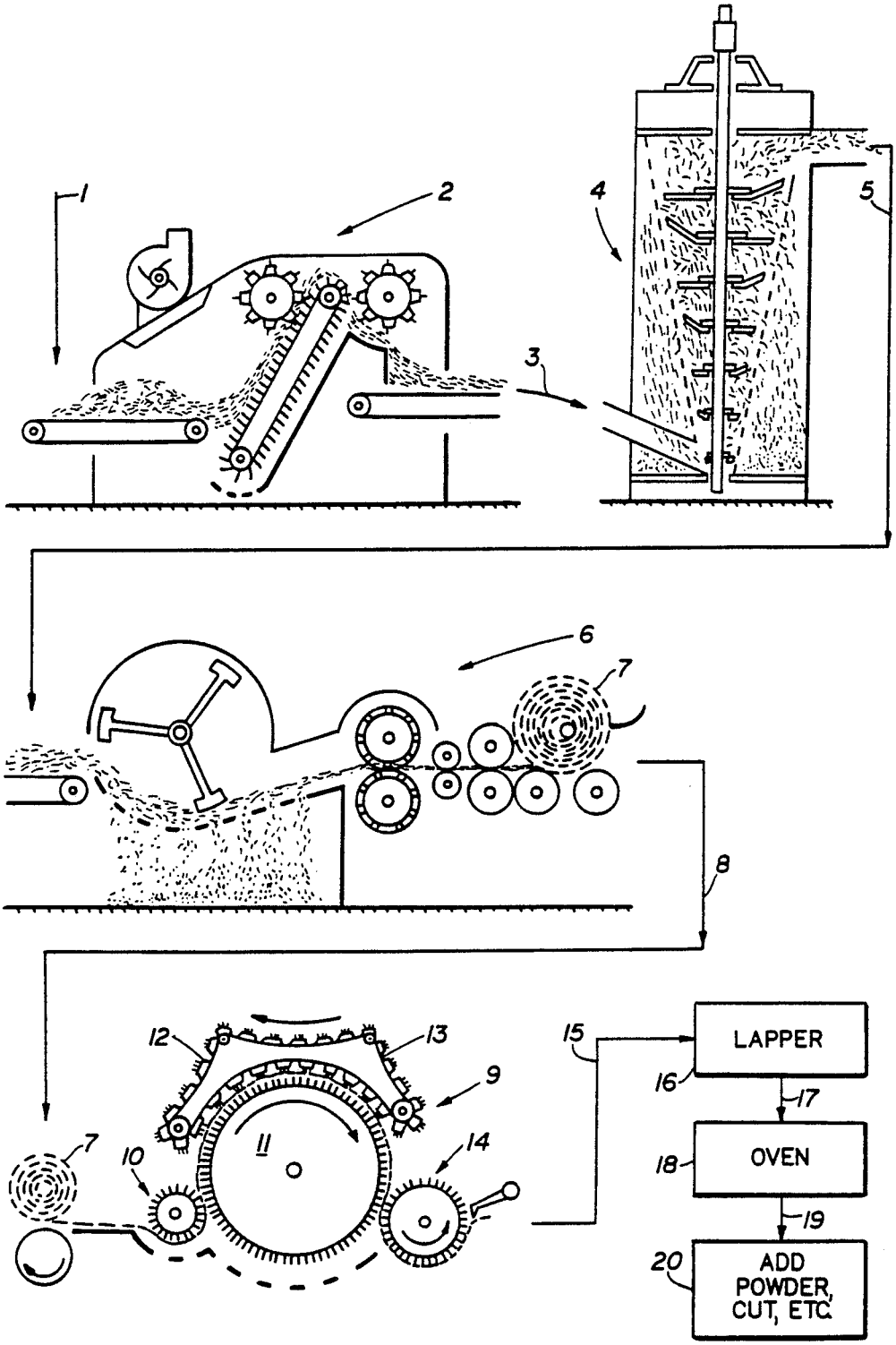
1
2
3
4
5
6
7
8
9
10
11
12
13
14
15
16
17
18
19
20
LAPPER
OVEN
ADD POWDER, CUT, ETC.

METHOD OF MAKING LOW DENSITY INSULATION COMPOSITION

This invention relates to insulation and methods for producing the same.

More particularly, the invention relates to a method and apparatus for producing a low density thermal insulation batt which includes insulative fibers having a low denier and which includes binder fibers which have been softened to adhere to and interconnect insulative fibers in the batt.

In another respect, the invention relates to a method and apparatus for producing a thermal insulation batt of insulative fibers which also includes short stilt fibers which interconnect and space apart the insulative fibers to define interstitial air pockets intermediate the insulative fibers.

U.S. Pat. No. 4,678,822 to Lewellin describes a method for producing a bonded fiber insulation batt. In the Lewellin method, a carding machine is utilized to form a web. The web passes through a lapping machine which folds the web onto itself to form a batt. While the web is being lapped into batt form, a RHOPLEX resin emulsion is sprayed onto the web. The batt formed by the lapping machine is heated to dry the resin expulsion. The resin sprayed on the batt is important, because Lewellin relies on the resin to ensure the batt retains its bulk and structural integrity. In his patent, Lewellin notes that two advantages of an insulation batt produced by his method are that the batt does not present the health hazard of fiberglass batts and that the batt occupies a lesser space than fiberglass batts. Finally, Lewellin notes that the insulative value of his batt is equal to that of a fiberglass batt. The density of the Lewellin batt is about 1.5 lbs/ft. The resin increases the density of the Lewellin batt.

While the insulation batt described in the Lewellin patent has advantages over conventional fiberglass insulation batts, Lewellin does not address the problem of producing a low density insulation batt which does not require the use of a resin spray to bond together insulative fibers in the batt. Reducing the density of an insulation batt and eliminating the use of a resin spray significantly reduces the cost of producing and utilizing the batt. A low density insulation batt requires less material in manufacture and costs less to transport.

Accordingly, it would be highly desirable to provide an improved low density insulation batt which would not require the use of conventional spray resins to bond together insulative fibers comprising the batt.

Therefore, it is a principal object of the invention to provide an improved method and apparatus for producing insulation and to provide an improved insulation batt.

A further object of the invention is to provide an improved insulation batt which has a significantly lower density than conventional batts.

Another object of the instant invention is to provide an improved method for producing an insulative batt, the method not requiring the utilization of spray apparatus to apply a resin to the batt to bind together insulative fibers comprising the batt.

Still another object of the invention is to provide an improved insulation composition which utilizes relatively short stilt fibers to interconnect and space apart insulative fibers to maintain interstitial air pockets thereinbetween.

Yet still a further object of the invention is to provide an improved insulation composition which includes binder fibers which have a softening temperature less than the melting temperature of the insulative fibers comprising the majority of the batt, the insulation batt being heated to a temperature greater than the softening temperature and less than the melting temperature to soften the binder fibers and cause them to adhere to and interconnect insulative fibers.

These and other, further and more specific objects and advantages of the invention will be apparent to those skilled in the art from the following detailed description thereof, taken in conjunction with the drawing, which depicts the method of manufacture of an insulation batt in accordance with the principles of invention.

Briefly, in accordance with my invention, I provide a method for forming a thermal insulation batt. The method includes the steps of blending at a first selected temperature binder fibers with insulative fibers, the binder fibers having a bonding temperature at which the binder fibers soften and adhere to the insulative fibers, the insulative fibers being selected from the group consisting of synthetic and natural fibers and having a melting temperature greater than the bonding temperature and at which at least certain of the insulative fibers melt, the bonding temperature being greater than 130° F. and greater than the first selected blending temperature; processing the blended fibers at a second selected temperature less than the bonding temperature to form a batt; heating the batt to a temperature equal to or greater than the bonding temperature and less than the melting temperature to cause the binder fibers to soften and adhere to the insulative fibers to connect insulative fibers to one another; and, cooling the batt to harden the softened binder fibers.

In another embodiment of my invention, I provide an improved method for forming a thermal insulation batt. The method includes the steps of processing at a first selected temperature insulative fibers to form a web having a selected thickness, the insulative fibers being selected from the group consisting of synthetic and natural fibers and having a melting temperature at which at least certain of the insulative fibers melt, the melting temperature being greater than the first selected temperature; transporting at a second selected temperature the web to a lapping machine to be lapped into a batt having a thickness greater than the web; lapping at a third selected temperature the web with the lapping machine to form a batt having a greater thickness than the web; transporting at a fourth selected temperature the batt from the lapping machine to apparatus for heating the batt to a temperature greater than or equal to a selected softening temperature and less than said melting temperature; applying binder fibers to said web during at least one of the process steps selected from the group consisting of steps (b), (c), and (d), the binder fibers softening and adhering to the insulative fibers at the selected softening temperature, the softening temperature being greater than 130° F., less than the melting temperature, and greater than the selected temperature for the one(s) of the steps (b), (c), and (d) during which the binder fiber are applied to the web at the selected temperature for the one(s) of the steps (b), (c), and (d); heating the batt with the heating apparatus to a temperature equal to or greater than the selected softening temperature and less than the melting temperature to cause the binder fibers to soften and adhere to the insulative fibers to connect certain of the insulative fibers to one another; and, cooling the batt to harden the softened binder fibers.

Turning now to the drawing, which depicts the presently preferred embodiments of the invention for the purpose of illustrating the practice thereof and not by way of limitation of the scope of the invention, a method for producing an insulative batt is illustrated in which bales of cotton 1 or another insulative or "bulk" fiber are first loosened up and separated into individual fibers or small groups of fibers by the hopper bale-breaker 2. Other hopper bale-breakers 2 are utilized to "open" binder fibers stilt fibers or other types of fibers to be blended with or added to fibers produced by bale-breaker 2. Fibers from hopper bale-breaker 2 are directed 3 into blender-opener 4. Binder fibers, stilt fibers, or other types of insulative fibers can be added to blender-opener 4 in any desired proportion with insulative fibers 3 from hopper-breaker 2. Fibers from blender-opener 4 are transported 5 to the picker or scutcher 6. Picker 6 forms the loose fibers into a sheet (the "lap") which is wound into a roll 7. Roll 7 is transported 8 to a revolving flat card machine 9 and fed into machine 9. Card machine 9 includes a taker-in roller or licker-in 10 provided with teeth which tear away small bunches of fiber from the lap. Main cylinder 11 is provided with teeth which strip small bunches of fiber from the licker-in. Narrow bars or flats 12 are carried by an endless belt 13 and are provided with teeth which exercise a combing action and remove impurities. The web from main cylinder 11 travels around doffer 14 and is directed or transported 15 to a lapper 16. The lapper folds the web 15 upon itself to produce a batt of desired thickness. Lapper 16 is preferably a cross-lapper, but can be any conventional lapper machine. Similarly, card machine 9, picker 6, blender-opener 4 and bale-breaker 2 can be replaced with any conventional apparatus performing similar functions with respect to the insulative, stilt, and binder fibers used in the practice of the method of the invention. Batt produced by lapper 16 is transported 17 to a bonding oven 18 which heats the batt to a temperature sufficient to soften binder fibers contained in the batt. When the binder fibers soften, they adhere to insulative fibers and bind the insulative fibers to one another. The binder fibers can be intermixed with insulative fibers in blender-opener 4 or added to the web during its transport 15 to lapper 16, during lapping 16, or during transport 17 of the lapped web to oven 18. Heat treated batt from oven 18 is cooled and transported 19 to additional processing stations 20. Stations 20 can add fire retardant to the batt in the form of a spray or powder. Common fire retardation compositions include borates, aluminum hydrate, halogenated hydrocarbons, and decabromo diphensyl dether. Chemical preservatives can be added to the batt to resist mildew and attach by insects. If desired, such fire retardants and chemical preservatives can be added to the web at any convenient processing point before or after the web is produced by card machine 9.

Another procedure performed by processing stations 20 is cutting the batt. The batt can be cut into short segments, balls, and any other desired shape and dimension.

The insulative fiber(s) added to blender-opener 4 can be selected from natural fibers like cotton, wool, flax, jute, mohair, silk, ramie, hemp and asbestos or from synthetic fibers like rayon, acetate, nylon, polyester, polyenes, acrylics, vinyons, kevlar or other monoacrylic, acrylic, or polyamide fibers. The proportion of an insulative fiber added to the blender-opener 4 can vary as desired and typically is in the range of 0% to 95% by weight. As earlier noted, a binder fiber is added to the insulative fibers. Binder fibers are added to blender-opener 4 in the proportion in the range of two to eighty percent by weight of the insulative or bulk fiber. The binder fiber has a softening temperature which is less than the melting temperature of any of the insulative fibers added to blender-opener 4. Accordingly, when a batt from lapper 16 passes through oven 18, oven 18 is heated to a temperature equal to or greater than the softening temperature of the binder fiber and less than the melting temperature of any of the insulative or bulk fibers. Oven 18 thus causes the binder fibers to soften and adhere to the insulative fibers and bond or interconnect insulative fibers to one another. As used herein, the term "soften" when applied to binder fibers means that the binder fiber begins to lose its hardness and/or melts such that the binder fiber can adhere to and interconnect insulative fibers after the binder fibers are heated to a selected temperature and then cooled to a normal room temperature of 78° F. Some binder fibers become "sticky" and adhere to an insulative fiber before the binder fiber melts. Other binder fibers have to melt before they will adhere to insulative fibers. A melted binder fiber and a softened "sticky" binder fiber each comprise a "softened" binder fiber. The presently preferred binder fiber is a polyester fiber. Any other desired synthetic or natural fiber can be utilized as a binder fiber.

The use of polyester fibers is known in connection with the production of medical blankets and feminine hygiene pads. In such uses, polyester fibers form a water resistant layer. For example, on medical blankets of the type utilized in operating rooms, polyester fibers form the backing of the blanket. On KOTEX feminine hygiene napkins, a water resistant sleeve made from polyester surrounds the inner absorbent part of the napkin. These uses bear no relation to the production of thermal insulation and do not suggest the function of polyester binder fibers in the method of the invention.

The binder fibers can be added to lap 7 or can be added to the web at any point after the web is produced by card machine 9 and prior to heating of the batt in oven 18. The melting temperature of the binder fibers can vary as desired as long as the melting temperature is greater than the temperature(s) at which the binder fibers are processed by machines 4, 6, 9, and 16 is the method of the invention up until the batt is heated in oven 18, provided that the melting temperature as long as the melting temperature of the insulative fibers is greater than the softening temperature of the binder fibers, and provided that the softening temperature is at least 130° F. Binder fibers with softening temperatures less than 130° F. are inconvenient because the binder material may soften or melt when maintained in an non-air conditioned storage shed in the summer or in the enclosed non-air conditioned bed of a vehicle. The preferred melting temperature of the binder fibers is presently in the range of 180° F. to 450° F. The binder fibers can take the form of actual fibers or of powder produced from fibers or from the material used to make the fibers. Adding binder fibers in powder form, particularly in blender-opener 4, can the advantageous. In contrast, the insulative fibers comprising a large portion of the batt are in true fiber form. Other wise, the insulative fibers could not be processed by bale-breaker 2, blender binder opener 4, picker 6, and card machine 9. The fibers have a length in the range of 0.5 to 2.0 inches, with a length of 1.5 inches being preferred. Eastman Kodak 410 binder fiber is presently a preferred binder fiber in the practice of the invention.

The insulative fiber(s) 1 used in the practice of the invention are 0.5 inches or longer, and are typically in the range of 0.5 inch to 1.5 inches long. The insulative fiber can have denier in excess of 3.0, but a denier of 3.0 or less is preferred because the insulative batt produced is unusually light. When cotton is utilized, a denier in the range of 2.4 to 3.0 is preferred. The web produced by the card machine 9 has a preferred thickness in the range of 1/16 inch to 3/16 inch, even though a card machine can produce much thinner or thicker webs. By way of example, when a Hollinsworth 2.5-Meter-working-width MASTERCARD card machine is utilized, the licker-in roll 10 uses wire in the range of 40 to 50 teeth per square inch, preferably 50 teeth per square inch, and a working angle of 15° to 25°, preferably 20°; the main cylinder 11 uses wire in the range of 300 to 700 teeth per square inch, preferably 500 teeth per square inch, and a working range in the range of 17° to 27°, preferably 22°; and, the doffer 14 uses wire in the range of 150 to 250 teeth per square inch, preferably 250 teeth per square inch, and a working angle in the range of 17° to 27°, preferably 22°. If desired, a plurality of card machines 9 can be utilized to produce web fed to lapper 16. An air lay machine, garnett or comparable web weaving machine can be utilized in place of card machine 9. The air lay machine produces a heavier non-uniform web. A garnett machine would produce web having larger air pockets than the web produced by card machine 9. The card machine is preferred in the practice of the invention because it discretely separates fibers and produces a relatively uniform fine kleenex-like spider web principally comprised of parallel, elongate strands of thread. These parallel strands comprise approximately 80% to 85% by weight, or more, of the web, while the remaining weight of the web consists of strands which are at an angle to and interconnect the parallel, elongate strands. Accordingly, when web produced by a card machine 9 is cross lapped 16, each succeeding layer of web in the batt has a longitudinal axis which is parallel to the parallel, elongate strands comprising the majority of the web layer and which is rotated 20° to 60°, preferably 30°, from the longitudinal axis of the preceding web layer in the batt.

When web produced by card machine 9 is being lapped by lapper 16, stilt fibers can be spread on a lapped layer of web just prior to the time that lapper 16 covers the first lapped layer of web with another web layer. These stilt fibers are 1/16 inch to ⅜ inch long, preferably ⅛ inch to ½ inch long. The stilt fibers function to spread apart and maintain a space between adjacent lapped web layers comprising the batt. When the batt is heated in oven 18, softened binder fibers adhere to and interconnect stilt fibers and insulative fibers. When the stilt fibers are applied to the web, additional binder fibers can be applied with the stilt fibers to facilitate the bonding of stilt fibers to insulative fibers. Stilt fibers are preferably applied to horizontally disposed layers of web during lapping of the web by lapper 16 because the stilt fibers tend to "ride" on top of a lower layer of web to separate the lower layer from the web layer adjacent and just above the lower layer. When the batt is heated by oven 18, the stilt layers are bonded to insulative fibers and the stilt fibers intermediate two adjacent web layers maintain a spacing in the range of 1/32 inch to 1/8 inch, typically 1/16 inch. The spacing between web layers produced by the stilt fibers significantly increases the insulative value and decreases the weight of insulation produced in accordance with the invention. Stilt fibers can, if desired, be blended with longer insulative fibers in blender-opener 4 or can be spread on or applied to the web at any point in the process of the invention after the web is produced by and leaves the card machine 9. KODAFIL 435 is a synthetic fiber which can be utilized as a stilt fiber, as are cotton fibers having a length in the range of ⅛ inch to ⅜ inch. Stilt fibers, like insulative fibers, have a melting point or temperature which is greater than the softening temperature of binder fibers used in the insulation batt of the invention.

The following examples are presented, not by way of limitation of the scope of the invention, but to illustrate to those skilled in the art the practice of various of the presently preferred embodiments of the invention and to distinguish the invention from the prior art.

EXAMPLE 1

Cotton fibers having a length of ⅞ inch are selected as insulative fibers. Cotton gin moates and linters each having a length in the range of ⅛ inch to ¼ inch are selected as stilt fibers. E. I. du Pont Dacron D-262 polyester fibers are selected as binder fibers. The insulative fibers and stilt fibers have a denier of 2.8. The polyester fibers have a denier of 1.8, an elongate percent of 200, a length of 1.5 inches, a melting point of 142° C. (softening at 78° C.) and a bonding temperature of 155° C. with respect to cotton, i.e., the Dacron D-262 polyester bonds to cotton fibers when heated to 155° C. The melting point of the insulative fibers exceeds 160° C.

The insulative fibers, stilt fibers, and binder fibers are blended together in a blender-opener 4 and processed with a picker 6 and card machine 9 to form a web which is transported 15 to a lapper 16. The insulative fibers comprise 60% by weight of the blended mixture; the cotton moates 20% by weight of the blended mixture; and, the binder particles 20% by weight of the blended mixture. The batt produced by lapper 16 is transported 17 to oven 18. The batt is heated in oven 18 to a temperature equal to or in excess of 155° C. to soften the polyester binder fibers and bond them to the insulative and stilt fibers. After being removed from oven 18 and cooled, the batt is cut 20 into six foot long sections and packaged. The batt is 2.9 inches thick and one foot wide and has a density of 8 ounces per cubic foot. The thickness, length, and width of the batt can be varied as desired. The insulation value or "R value" of the batt is R-11. The "R-value" of insulation indicates the time in hours required for one BTU to be transmitted through a one square foot area of the insulation when there is a difference of one degree Fahrenheit between the two opposing outer surfaces of the insulation.

The 2.9 inch thick R-11 batt produced in this Example is lighter than a comparably sized fiberglass batt and has a greater R value than the fiberglass batt.

EXAMPLE 2

Cotton fibers having a length of one inch, wool fibers having a length of ⅞ inch, and rayon fibers having a length of 1.5 inches are selected as insulative fibers. Cotton gin moates and linters and acrylic fibers each having a length in the range of ⅛ inch to ¼ inch are selected as stilt fibers. E. I. du Pont D-262 polyester fibers are selected as binder fibers. The insulative fibers and stilt fibers have a denier of 2.6. The polyester fibers have a denier of 2.2, and elongate percent of 200, a length of one inch, a melting point of 142° C. (softening at 78° C.) and a bonding temperature of 100° C. with respect to cotton and 120° C. with respect to acrylic fibers. The melting point of the insulative fibers exceeds 130° C.

The insulative fibers and binder fibers are blended together in a blender-opener 4 and processed with a picker 6 and card machine 9 to form a web which is transported 15 to lapper 16. The stilt fibers are separately blended together in a blender-opener 4 with binder fibers to form a stilt-binder fiber mixture. The insulative fibers comprise 70% by weight of the web produced by the card machine 9, while the binder fibers comprise 30% by weight of the web produced by card machine 9. The stilt fibers comprise 60% by weight of the stilt-binder binder fiber mixture, while the binder fibers comprise 40% by weight of the stilt-binder fiber mixture. While the web produced by card machine 9 is being lapped, a ⅛ inch to ¼ inch layer of the stilt-binder fiber mixture is spread on the upper horizontal surface of each layer of the web deposited by the lapper 16. The layer of the stilt-binder fiber mixture is deposited before the lapper 16 lays down on the upper horizontal surface of a deposited or "laid" web layer the next subsequent layer. Accordingly, after lapper 16 has produced a batt, each adjacent pair of horizontally oriented web layers comprising the batt will sandwich a stilt-binder fiber layer which is ⅛ inch to ¼ inch thick.

The batt produced by lapper 16 is heated in oven 18 to a temperature of 120° C. so the binder fibers soften and bond to both the cotton and acrylic insulative fibers. After the binder fibers have bonded to the insulative fibers, the batt is removed from the oven and cooled. At processing stations 20 the batt is cut into lengths 50 feet long and rolled and packaged. The batt is 2.9 inches thick, 1 foot wide and has an R value of about 12. The thickness, width and length of the batt can be varied as desired. The stilt fibers maintain a spacing of about ⅛ inch between adjacent web layers in the batt. The stilt-binder fiber mixture added to the batt comprises about 15% by weight of the finished batt, with the insulative-binder fiber mixture of the web comprising the remaining 85% by weight of the batt. The density of the batt is 7 ounces per cubic foot.

The stilt fibers can comprise 1% to 50% by weight of the insulation batt produced by the method of the invention. Preferably, the stilt particles comprise 5% to 20% by weight of the batt.

When the cotton batt of Example 2 is five inches thick, the R value of the batt is about 19. A fiberglass batt must be six inches thick to achieve an R value of 19. When the cotton batt of Example 2 is 7.9 inches thick, it has an R value of 30. A fiberglass batt must be 9.5 inches thick to achieve an R value of 30. When the cotton batt of Example 2 is 2.9 inches thick, the R value of the batt is, as noted, about 11. A fiberglass batt with a thickness of 3.5 inches weighs 0.23 lbs per square foot of insulation. The 2.9 inch thick cotton insulation of Example 2 weighs about 0.12 lbs per square foot of insulation.

Having described my invention in such terms as to enable those skilled in the art to understand and practice it, and having identified the presently preferred embodiments thereof, I Claim:

1. A method for forming a thermal insulation batt, including the steps of (a) blending at a first selected temperature binder fibers with insulative fibers to produce a mixture of said binder and said insulative fibers in random orientation, said insulative fibers
  (i) being selected from the group consisting of natural fibers,
  (ii) having a melting temperature at which at least certain of said insulative fibers melt, said melting temperature being greater than said first selected temperature, and
  (iii) having a length in the range of 0.5 inch to 1.5 inches and having a denier of 3.0 or less,
  said binder fibers having a length in the range of 0.5 inch to 2.0 inches and having at least one bonding temperature at which said binder fibers soften and adhere to said insulative fibers, said bonding temperature being greater than 130° F., greater than said selected blending temperature, and less than said melting temperature of said insulative fibers;

(b) feeding said mixture of fibers into processing—carding means to produce a web
  (i) having a thickness in the range of 1/16 inch to 3/16 inch, and
  (ii) comprised principally of parallel elongate strands of thread, (c) transporting at a second selected temperature said web to a lapping machine to be lapped into a batt having
  (i) a plurality of overlaid folded web layers; and,
  (ii) a thickness greater than the thickness of said web;

(d) folding at a third selected temperature said web with said lapping machine to form one of said folded web layers;

(e) applying a layer of spacer stilt fibers in random orientation to said one of said folded web layers to ride on top of said one of said folded layers, said spacer stilt fibers each having a length in the range of 1/16 to ⅜ inch and having a melting temperature at which at least certain of said stilt fibers melt;

(f) folding said web with said lapping machine to form another of said folded web layers extending over and contacting said layer of stilt fibers;

(g) transporting at a fourth selected temperature said batt from said lapping machine to apparatus for heating said batt to said bonding temperature, said bonding temperature being
  (i) less than said melting temperature of said stilt fibers, and
  (ii) greater than said second, third and fourth selected temperatures;

(h) heating said batt with said heating apparatus to a temperature equal to or greater than said bonding temperature to cause said binder fibers to soften and adhere to said insulative fibers and stilt fibers such that
  at least certain of said stilt fibers interconnect insulative fibers in said one of said layers and said another of said layers, and
  said stilt fibers maintain a spacing between said one of said layers and said another of said layers in the range of 1/32 inch to ⅛ inch; and, (i) cooling said batt to harden said softened binder fibers, said cooled batt having a density of less than 1.0 pound per cubic foot.

2. A method for forming a thermal insulation batt, including the steps of (a) blending at a first selected temperature insulative fibers to produce a mixture of said said insulative fibers in random orientation, said insulative fibers
(i) being selected from the group consisting of natural fibers,
(ii) having a melting temperature at which at least certain of said insulative fibers melt, said melting temperature being greater than said first selected temperature, and
(iii) having a length in the range of 0.5 inch to 1.5 inches and having a denier of 3.0 or less,
(b) feeding said mixture of fibers into processing—carding means to produce a web
(i) having a thickness in the range of 1/16 inch to 3/16 inch, and
(ii) comprised principally of parallel elongate strands of thread,
(c) blending at a second selected temperature binder fibers with stilt fibers to produce a supplemental mixture comprised of said binder and stilt fibers in random orientation, said stilt fibers having a melting temperature at which at least certain of said stilt fibers melt, said binder fibers having a length in the rang of 0.5 inch to 2.0 inches and having at least one bonding temperature at which said binder fibers soften and adhere to said insulative fibers and said stilt fibers, said bonding temperature being greater than 130° F. and greater than said first and second selected temperatures and less than said melting temperature of said insulative fibers and said melting temperature of said stilt fibers;
(d) transporting at a third selected temperature said web to a lapping machine to be lapped into a batt having
(i) a plurality of overlaid folded web layers; and,
(ii) a thickness greater than the thickness of said web;
(e) folding at a fourth selected temperature said web with said lapping machine to form one of said folded web layers;
(f) applying a layer of said supplemental mixture of fibers to said one of said folded web layers to ride on top of said one of said folded layers, said spacer stilt fibers in said supplemental mixture each having a length in the range of 1/16 to ⅜ inch and having a melting temperature at which at least certain of said stilt fibers melt;
(g) folding said web with said lapping machine to form another of said folded web layers extending over and contacting said layer of said supplemental mixture of said stilt fibers;
(h) transporting at a fifth selected temperature said batt from said lapping machine to apparatus for heating said batt to said bonding temperature, said bonding temperature being greater than said third, fourth and fifth selected temperatures;
(i) heating said batt with said heating apparatus to said bonding temperature to cause said binder fibers to soften and adhere to said insulative fibers and to said stilt fibers such that
at least certain of said stilt fibers interconnect insulative fibers in said one of said layers and said another of said layers, and
said stilt fibers maintain a spacing between said one of said layers and said another of said layers in the range of 1/32 inch to ⅛ inch; and,
(j) cooling said batt to harden said softened binder fibers, said cooled batt having a density of less than 1.0 pound per cubic foot.

3. A method for forming a thermal insulation batt, including the steps of
(a) blending at a first selected temperature insulative fibers to produce a mixture of said insulative fibers in random orientation, said insulative fibers having a melting temperature at which at least certain of said insulative fibers melt, said melting temperature being greater than said first selected temperature;
(b) feeding said mixture of fibers into processing means to produce a web;
(c) blending at a second selected temperature binder fibers with stilt fibers to produce a supplemental mixture comprised of said binder and stilt fibers in random orientation, said stilt fibers having a melting temperature at which at least certain of said stilt fibers melt, said binder fibers having a length in the rang of 0.5 inch to 2.0 inches and having a bonding temperature at which said binder fibers soften and adhere to said insulative fibers and said stilt fibers, said bonding temperature being greater than 130° F. and greater than said first and second selected temperatures and less than said melting temperature of said insulative fibers and said melting temperature of said stilt fibers;
(d) transporting at a third selected temperature said web to a lapping machine to be lapped into a batt having
(i) a plurality of overlaid folded web layers; and,
(ii) a thickness greater than the thickness of said web;
(e) folding at a fourth selected temperature said web with said lapping machine to form one of said folded web layers;
(f) applying a layer of said supplemental mixture of fibers to said one of said folded web layers to ride on top of said one of said folded layers, said stilt fibers in said supplemental mixture each having a length in the range of 1/16 to ⅜ inch and having a melting temperature at which at least certain of said stilt fibers melt;
(g) folding said web with said lapping machine to form another of said folded web layers extending over and contacting said layer of said supplemental mixture of said stilt and binder fibers;
(h) transporting at a fifth selected temperature said batt from said lapping machine to apparatus for heating said batt to said bonding temperature, said bonding temperature being greater than said third, fourth and fifth selected temperatures;
(i) heating said batt with said heating apparatus to said bonding temperature to cause said binder fibers to soften and adhere to said insulative fibers and said stilt fibers such that
at least certain of said stilt fibers interconnect insulative fibers in said one of said layers and said another of said layers, and
said stilt filers maintain a spacing between said one of said layers and said another of said layers in the range of 1/32 inch to ⅛ inch; and,
(j) cooling said batt to harden said softened binder fibers, said cooled batt having a density of less than 1.0 pound per cubic foot.

4. A method for forming a thermal insulation batt, including the steps of (a) blending at a first selected temperature binder fibers with insulative fibers to produce a mixture of said binder and said insulative fibers in random orientation, said insulative fibers having a melting temperature at which at least certain of said insulative fibers melt, said melting temperature being certain of said insulative fibers melt, said melting temperature being greater than said first selected temperature, said binder fibers having a bonding temperature at which said binder fibers soften and adhere to said insulative fibers, said bonding temperature being greater than 130° F. and greater than said selected blending temperature and less than said first selected temperature;

(b) feeding said mixture of fibers into processing means to produce a web;

(c) transporting at a second selected temperature said web to a lapping machine to be lapped into a batt having (i) a plurality of overlaid folded web layers; and, (ii) a thickness greater than the thickness of said web;

(d) folding at a third selected temperature said web with said lapping machine to form one of said folded web layers;

(e) applying a layer of spacer stilt fibers in random orientation to said one of said folded web layers to ride on top of said one of said folded layers, said spacer stilt fibers each having a length in the range of 1/16 to ⅜ inch and having a melting temperature at which at least certain of said stilt fibers melt;

(h) folding said web with said lapping machine to form another of said folded web layers extending over and contacting said layer of said supplemental mixture of said stilt fibers;

(g) transporting at a fourth selected temperature said batt from said lapping machine to apparatus for heating said batt to said bonding temperature, said bonding temperature being (i) less than said melting temperature of said stilt fibers, and (ii) greater than said second, third and fourth selected temperatures;

(h) heating said batt with said heating apparatus to said bonding temperature to cause said binder fibers to soften and adhere to said insulative fibers and said stilt fibers such that at least certain of said stilt fibers interconnect insulative fibers in said one of said layers and said another of said layers, and said stilt fibers maintain a spacing between said one of said layers and said another of said layers in the range of 1/32 inch to ⅛ inch; and, (i) cooling said batt to harden said softened binder fibers, said cooled batt having a density of less than 1.0 pound per cubic foot.

5. The method of claim 1 wherein said insulative fibers are cotton.

6. The method of claim 2 wherein said insulative fibers are cotton.

7. The method of claim 3 wherein said insulative fibers are cotton.

8. The method of claim 4 wherein said insulative fibers are cotton.

9. The method of claim 5 wherein said stilt fibers are cotton.

10. The method of claim 6 wherein said stilt fibers are cotton.

11. The method of claim 7 wherein said stilt fibers are cotton.

12. The method of claim 8 wherein said stilt fibers are cotton.

* * * * *